United States Patent [19]

Bettis

[11] Patent Number: 4,667,343

[45] Date of Patent: May 26, 1987

[54] BOXING GLOVE COVER

[76] Inventor: Brian K. Bettis, 4682 Ringwood Meadow, Sarasota, Fla. 33581

[21] Appl. No.: 920,234

[22] Filed: Oct. 17, 1986

[51] Int. Cl.[4] ..... A41D 13/08; A41D 19/00

[52] U.S. Cl. ..... 2/18; 2/161 A

[58] Field of Search ..... 2/161 A, 161 R, 160, 2/159, 18, 158

[56] References Cited

U.S. PATENT DOCUMENTS 1,401,722 12/1921 Oldham ..... 2/18

1,736,547 11/1929 Restifo ..... 2/18

*Primary Examiner*—Doris L. Troutman

*Attorney, Agent, or Firm*—Charles J. Prescott; Raymond H. Quist

[57] ABSTRACT

A cover for a boxing glove for holding the thumb enclosure of the boxing glove against the glove. The cover also provides a smooth back for a glove which has been worn and abraded so that the glove can continue to be used without producing abrasions from the worn surface. The thumb holding or retaining portion may be elasticized. Laces or other means may be used to secure the cover to the glove.

12 Claims, 5 Drawing Figures

BOXING GLOVE COVER

BACKGROUND OF THE INVENTION

1. Field of the Invention

This invention relates generally to a boxing glove cover, and more particularly to a boxing glove cover which will prevent the thumb or the boxing glove from moving out from a position adjacent to the fingers.

2. Description of Related Art

Boxing gloves, particularly those used by professional fighters, are fairly complex and expensive; but never-the-less are typically discarded when the back of the glove becomes worn so that continuing to use it will cause skin abrasions or cuts on the opponent.

Boxing gloves which have been used have also included a separate thumb enclosure in addition to the main glove portion which encloses the fingers and the rest of the hand. This separate thumb enclosure has resulted in eye injuries which it is now believed would have been avoided had the thumb been confined. New rules or regulations will require that the thumb be prevented from movement away from the other fingers. This change will make existing gloves not acceptable for use in boxing matches and may discourage their use even in sparring.

This invention is a boxing glove cover which will enable the use of existing separate thumb enclosure gloves and worn gloves.

It is therefore an object of this invention to provide a boxing glove cover which will retain the separate thumb enclosure of a boxing glove adjacent to the portion of the glove enclosing the fingers.

It is also an object of this invention to provide a boxing glove cover which will provide a new, unblemished back cover for a boxing glove so that the boxing glove may continue to be used after the original back cover is damaged.

SUMMARY OF THE INVENTION

A cover is provided which can be positioned over a boxing glove and secured in place using laces or the like. The thumb of the boxing glove can be shifted slightly within this cover. The portion of the cover which is adjacent to the protruding thumb tip, is extended across the palm and held by elasticized material in this position. This arrangement permits the boxer to move his thumb to a comfortable position in forming a fist.

DETAILED DESCRIPTION OF THE INVENTION

Throughout this description and associated drawings the cover for a right glove is referred to. The left cover would be made of the complementary configuration.

Figure 1:
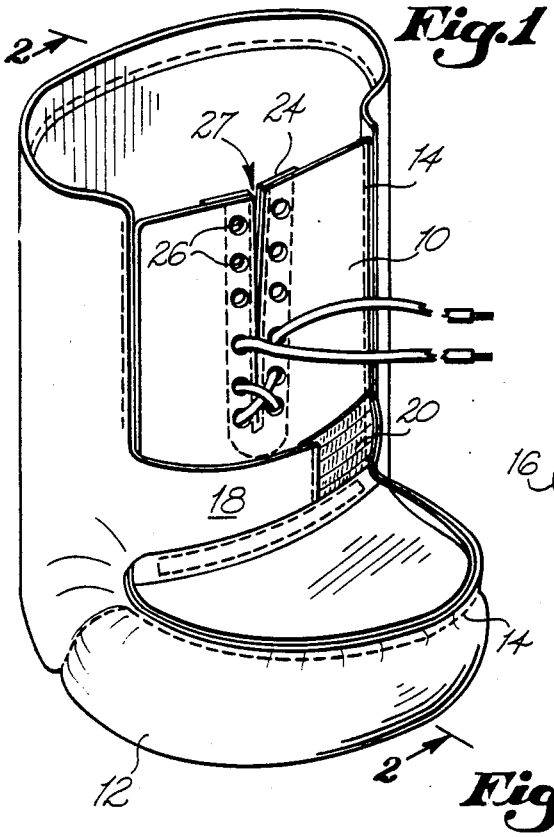
FIG. 1 is a perspective view of a boxing glove cover in accordance with the invention.
Figure 2:
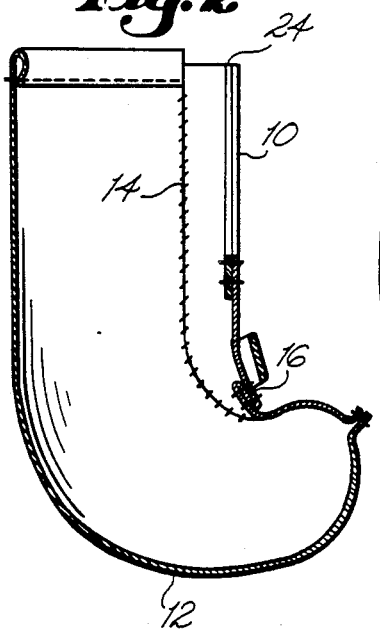
FIG. 2 is a cross-sectional elevation of the boxing glove cover of FIG. 1.

Referring to FIGS. 1 and 2, the boxing glove cover has a palm cover portion 10 and a back cover portion

12. It will be noted that the back cover portion extends around the sides while the palm cover portion is comparatively rather narrow. Also, the back cover portion extends longitudinally a longer distance than the palm cover portion. This comparative sizing puts the seams 14, which join the palm cover portion 10 and the back cover portion 12, in a location where they are not likely to come in contact with the opponent when a blow is struck.

Figure 3:
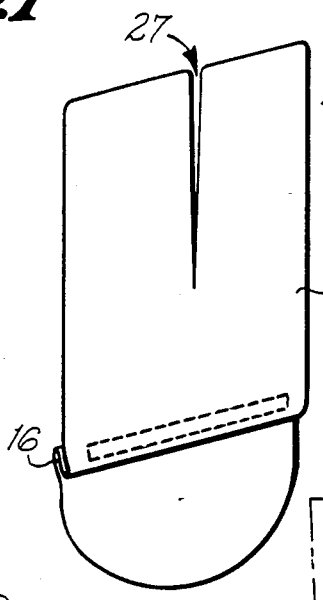
FIG. 3 is a detail of the palm cover portion.

As mentioned above, palm cover portion 10 is narrow compared to back cover portion 12. Palm cover portion 10 is also shorter than back cover portion 12 to accomodate the configuration associated with the clenched fist. This accomodation is also facilitated by including a fold 16 in palm cover portion 10 (shown also in FIG. 3). Fold 16 is stitched to hold it in place only in the center portion so that the edges of palm cover portion may be fully extended in forming seams 14. This tends to pull back cover portion 12 into the clenched fist configuration shown. Palm cover portion 10 includes reinforcement 24 for lace holes 26. Lace holes 26 are positioned at spaced intervals on each side of slit 27.

Figure 4:
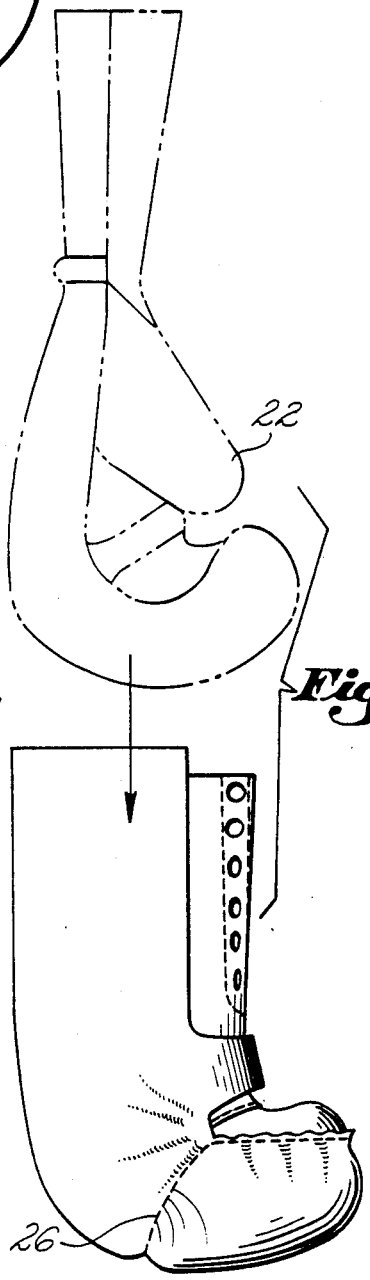
FIG. 4 shows the boxing glove cover with a phantom view of the boxing glove it is intended to cover.
Figure 5:
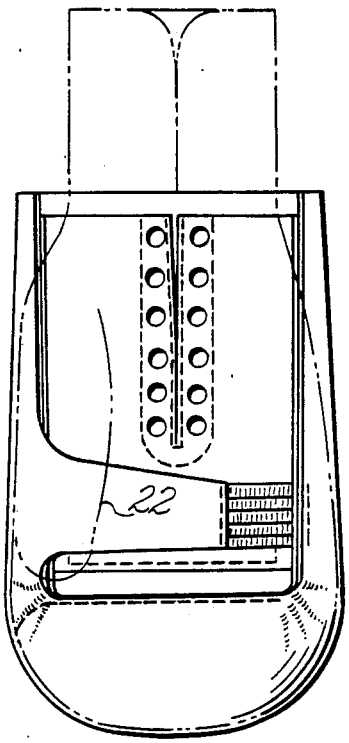
FIG. 5 shows the boxing glove cover in place over a boxing glove shown in phantom view.

As is clearly shown in FIG. 1, band 18 extends from back cover portion 12 partially across palm cover portion 10. Band 18 is held in this position by being secured to one end of elasticized material 20. The other end of elasticized material 20 is secured at the far side of palm cover portion 10, for example in seam 14. Band 18 holds thumb 22 of the boxing glove (FIGS. 4 and 5) in next to the curled finger portion of the glove, but elasticized material 20 permits limited shifting or movement of the thumb within the cover of this invention. Because band 18 is a portion of back cover 12, seam 14 is discontinued at band 18. A seam 26 extends from seam 14 below band 18 which secures a fold of the back cover material.

As is well recognized, the prehensile positioning of the thumb makes it uncomfortable to place it in a common enclosure with the fingers. Consequently, mittens and boxing gloves typically include a separate thumb enclosure. The boxing glove cover of this invention accordingly is designed to cover a boxing glove having a thumb, but also allows the thumb to be moved to a comfortable position without permitting movement enough to result in gouging of the eyes.

The back cover portion 12 should be formed from a material which is smooth, cut and abrasion resistant, such as leather. Kangaroo hide is a preferred leather. Palm cover portion 10 may also be a leather, but because it will not receive the direct blows from the use of the glove; may also be of other materials. An elasticized material may be preferred, and this material makes the laces illustrated unnecessary. Although the boxing glove cover of this invention is illustrated as not extending to be coextensive with the boxing glove (see, for example FIG. 5) the minimum height should of course extend at least far enough to cover the padded portion of the glove normally used for boxing. It may extend higher.

While the instant invention has been shown and described herein in what is conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A boxing glove cover for a boxing glove having a palm, a back and a thumb comprising:

a palm cover portion;

a back cover portion connected to said palm cover portion; and securing means on said palm cover portion for causing said back cover portion to fit smoothly and tightly over the back of the boxing glove.

2. A boxing glove cover in accordance with claim 1 further comprising:

thumb retaining means extending across said palm cover from the thumb side of said back cover for holding the thumb of the boxing glove adjacent to the palm and back of the glove.

3. A boxing glove cover in accordance with claim 2 wherein:

said thumb retaining means includes an elastic portion.

4. A boxing glove cover in accordance with claim 2 wherein:

said thumb retaining means has a band which is an extension of said back cover.

5. A boxing glove cover in accordance with claim 1 wherein:

said back cover is wider than said palm cover; and said back cover is longer than said palm cover.

6. A boxing glove cover in accordance with claim 1 wherein:

said palm cover portion includes a laterally extending fold having lateral stitching to hold it in place; and said lateral stitching does not extend completely across said palm cover portion.

7. A boxing glove cover in accordance with claim 1 wherein:

said palm cover portion is formed at least partially of elasticized material.

8. A boxing glove cover in accordance with claim 1 wherein:

said back cover portion is formed of leather.

9. A boxing glove cover in accordance with claim 8 wherein:

said leather is kangaroo hide.

10. A boxing glove cover in accordance with claim 1 wherein:

said palm cover portion is formed of leather.

11. A boxing glove cover in accordance with claim 10 wherein:

said palm cover portion includes a longitudinally extending slit; and lace holes are spaced along each side of said slit.

12. A boxing glove cover comprising:

a palm cover portion having a laterally extending top edge; side edges extending longitudinally from said top edge, and a laterally extending, convexly curved bottom edge;

a back cover portion having a laterally extending top edge; a thumb side edge and an opposite side edge, said side edges extending longitudinally from said top edge; and a laterally extending, convexly curved bottom edge;

said back cover portion also having a band having a lateral end extending from said thumb side edge;

said palm cover portion and said back cover portion being connected to each other along said bottom edges and said side edges;

an elasticized material having one end connected to said lateral end of said band;

said elasticized material having its other end connected at the juncture of said opposite side edge of said back cover portion and said palm cover portion;

said palm cover portion having a slit longitudinally extending from said top edge; and lace holes positioned at spaced intervals along each side of said slit.

* * * * *